US006717078B2

(12) United States Patent
Yoshida et al.

(10) Patent No.: US 6,717,078 B2
(45) Date of Patent: Apr. 6, 2004

(54) COLLISION DETECTION APPARATUS DESIGNED TO MINIMIZE CONTACT CHATTER

(75) Inventors: Masatada Yoshida, Ichinomiya (JP); Kyojiro Suzuki, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/358,358

(22) Filed: Feb. 5, 2003

(65) Prior Publication Data

US 2003/0146078 A1 Aug. 7, 2003

(30) Foreign Application Priority Data

Feb. 7, 2002 (JP) ..... 2002-030982
Feb. 7, 2002 (JP) ..... 2002-031026

(51) Int. Cl.[7] ..... H01H 35/14
(52) U.S. Cl. ..... 200/61.53; 200/61.45 R
(58) Field of Search ..... 200/61.45 R–61.45 M; 73/488, 514.01, 514.16, 514.17, 514.14–514.24, 514.36–514.38

(56) References Cited

U.S. PATENT DOCUMENTS 2,120,980 A 6/1938 Johnston ..... 200/61.45 R
5,034,580 A * 7/1991 Tada et al. ..... 200/61.45 R
5,856,645 A * 1/1999 Norton ..... 200/61.53
5,898,144 A 4/1999 Sakai et al.
5,920,046 A * 7/1999 Takagi ..... 200/61.48
6,093,897 A * 7/2000 Inoue et al. ..... 200/61.45 R

FOREIGN PATENT DOCUMENTS

| | | | |
|---|---|---|---|
| DE | 2058864 | 5/1972 | ..... H01H/50/50 |
| FR | 1415375 | 10/1965 | |
| GB | 2128410 | 4/1984 | ..... H01H/1/26 |
| JP | 3191724 | 5/2001 | ..... H01H/35/14 |

* cited by examiner

*Primary Examiner*—Michael A. Friedhofer
(74) *Attorney, Agent, or Firm*—Posz & Bethards, PLC

(57) ABSTRACT

A collision detecting apparatus is provided which consists of a rotor and a first and a second contact spring. Upon collision, the rotor pushes the first contact spring to establish an electrical contact with the second contact spring. At least one of the first and second contact member is decreased in width from a base portion secured on a mount base to a contact portion, thereby decreasing the weight of the contact portion to avoid the contact chatter.

11 Claims, 4 Drawing Sheets

COLLISION DETECTION APPARATUS DESIGNED TO MINIMIZE CONTACT CHATTER

BACKGROUND OF THE INVENTION

1. Technical Field of the Invention

The present invention relates generally to a collision detection apparatus working to detect a mechanical impact more than a preset level upon an accidental vehicle collision, and more particularly to an improved structure of such a collision detection apparatus designed to minimize contact chatter in the apparatus.

2. Background Art

Japanese Patent No. 3191724 (U.S. Pat. No. 5,898,144, issued on Apr. 27, 1999, assigned to the same assignee as that of this application) discloses a conventional collision detector which, as shown in FIG. 5, consists of a rotor 3, a first contact spring 7, and a second contact spring 8. The rotor 3 is responsive to an impact arising from a vehicle crash to rotate and urge the first contact spring 7 into contact with the second contact spring 8, thereby producing an electrical signal. The second contact spring 8 is made up of two leaf springs in order to increase an elastic pressure required to secure the stability of contact between the first and second contact springs 7 and 8 without contact chatter.

Usually, most of vehicle collision detectors are installed in a front portion of a vehicle body (e.g., a front fender) for the purpose of early detection of a vehicle collision. Specifically, the vehicle collision detectors are placed in an environmental condition where they undergo a great deceleration and still have a difficulty in eliminating the contact chatter completely.

SUMMARY OF THE INVENTION

It is therefore a principal object of the invention to avoid the disadvantages of the prior art.

It is another object of the invention to provide a collision detecting apparatus which is designed to secure the stability of an electrical contact in the apparatus without any contact chatter.

According to one aspect of the invention, there is provided a collision detecting apparatus which may be employed in actuating a safety restraint system such as an air bag upon a vehicle crash. The collision detecting apparatus comprises: (a) a moving member moving when subjected to an impact of more than a given level arising from a collision with another object; and (b) a first and a second contact member which are disposed on a mount base and extend with a given gap therebetween. The first contact member is brought by the moving member into contact with the second contact member to produce an electrical signal indicative thereof when the moving member undergoes the impact of more than the given level. At least one of the first and second contact members is made of a leaf spring which has a length including a base portion secured on the mount base and a contact portion for establishing a contact with the other of the first and second contact members. The base portion is larger in width than the contact portion. This results in a decrease in weight of the contact portion, so that the contact portion remote from the mount base is less susceptible to vibrations to avoid contact chatter.

In the preferred mode of the invention, the at least one of the first and second contact members is decreased in width gradually from the base portion to the contact portion.

At least one of the first and second contact members may alternatively be decreased in width in a stepwise fashion from the base portion to the contact portion.

The leaf spring may have a reinforcement rib formed thereon to compensate for a loss in rigidity resulting from the decrease in width of the contact portion.

The second contact member is made up of a first and a second leaf spring. The first leaf spring works to establish the contact with the first contact member when pressed by the moving member. The second leaf spring works to produce an elastic pressure to urge the first leaf spring against the first contact member when the first contact member is pressed by the moving member and makes the contact with the second contact member.

A first point of the contact of the first contact member with the second contact member established by the moving member and a second point of contact of the moving member with the first contact member may be located at the same interval away from the mount base. In other words, the first point may coincide spatially with the second point. When brought into contact with the second contact member, the first contact member is pressed by the moving member on the first point, thereby suppressing mechanical vibrations of the first contact member on the first point to avoid the contact chatter.

BRIEF DESCRIPTION OF THE DRAWINGS

The present invention will be understood more fully from the detailed description given herein below and from the accompanying drawings of the preferred embodiments of the invention, which, however, should not be taken to limit the invention to the specific embodiments but are for the purpose of explanation and understanding only.

In the drawings:

FIG. 2(*b*) is a plane view which shows a modification of a contact spring which may be employed in the collision detector of FIG. 1;

DESCRIPTION OF THE PREFERRED EMBODIMENTS

Figure 1:
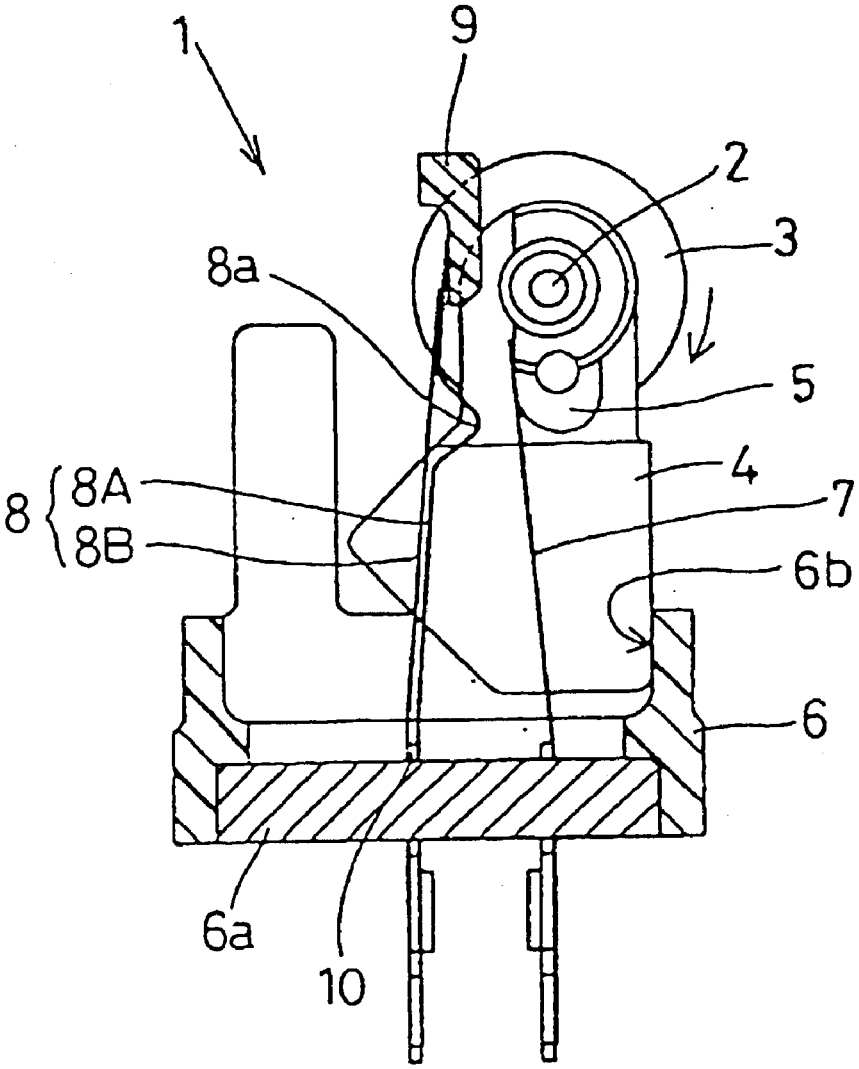
FIG. 1 is a partially sectional view which shows a collision detector according to the first embodiment of the invention.

Referring to the drawings, wherein like reference numbers refer to like parts in several views, particularly to FIG. 1, there is shown a collision detector 1 according to the first embodiment of the invention which works to detect a mechanical impact acting thereon. The following discussion will refer to an example in which the collision detector 1 is installed in an automotive vehicle to deploy an air bag upon a vehicle crash.

The collision detector 1 consists essentially of a rotor 3, first and second contact springs 7 and 8, a weight 4, and a housing 6. First and second contact springs 7 and 8 each have contact portions with surfaces that are slitless to increase mechanical strength and decrease a propensity of the contact members to vibrate and cause contact chatter.

The rotor 3 is installed within the housing 6 integrally with the weight 4. The center of gravity of the weight 4 is located eccentrically to an axis of rotation (i.e., a center shaft 2) of the rotor 3. The center shaft 2 is carried on an inner wall of the housing 6. When the vehicle equipped with the collision detector 1 (which will be referred to as a detector-equipped vehicle below) undergoes sudden deceleration upon collision with any object, e.g., another vehicle, it will cause moment to act on the center of gravity of the weight 4 in accordance with the law of inertia, thereby causing the rotor 3 to turn in a direction, as indicated by an arrow in the drawing, about the center shaft 2 along with the weight 4.

The rotor 3 has installed thereon a cam 5 which works to close the first and second contact springs 7 and 8 upon occurrence of a vehicle collision. The first and second contact springs 7 and 8 are secured on a mount base 6*a* of the housing 6 and extend vertically, as viewed in the drawing, with a given contact gap therebetween.

The first contact spring 7 is made of a single leaf spring and has an upper end abutting to a side surface of the cam 5 to provide a set spring load thereto which urges the rotor 3 elastically in a counterclockwise direction, as viewed in the drawing, to bring the weight 4 into constant engagement with an inner side wall 6*b* of the housing 6. This holds the rotor 3 from rotating in the clockwise direction when deceleration arising from mechanical vibrations during traveling of the detector-equipped vehicle or sudden braking is lower than a preselected level.

The second contact spring 8 is made up of two springs: a first leaf spring 8A and a second leaf spring 8B. The first leaf spring 8A has an upper end thereof which elastically abuts to a stopper 9 formed on the housing 6. The first leaf spring 8A has a protrusion or contact 8*a* which makes an electrical contact with the first contact spring 7 when the first contact spring 7 is pushed by the cam 5 moved by rotation of the rotor 3. The contact 8*a* is formed by bending a portion of the first leaf spring 8A to a triangular shape and located at a given interval away from the contact spring 7.

The second leaf spring 8B extends behind the back of the first leaf spring 8A. Specifically, the first leaf spring 8A is located between the second leaf spring 8B and the first contact spring 7. The second leaf spring 8B has an upper end abutting to the upper end of the first leaf spring 8A elastically to urge it against the stopper 9. A spacer 10 is disposed on the mount base 6*a* of the housing 6 between lower ends of the first and second leaf springs 8A and 8B to maintain a constant gap between the lower ends of the first and second leaf springs 8A and 8B. The lower ends of the first and second leaf springs 8A and 8B may alternatively be secured on the mount base 6*b* fixedly with the constant gap therebetween without use of the spacer 10.

The first and second contact springs 7 and 8 connect with contact terminals which are joined electrically to, for example, a printed circuit board (not shown) mounted in the housing 6 and work to connect or interrupt an electrical circuit path on the printed circuit board. The printed circuit board is connected to an ECU (Electronic Control Unit). When the first contact spring 7 makes a contact with the second contact spring 8 to close the electrical circuit path on the printed circuit board, an electrical signal indicating such an event is produced and outputted to the ECU. The ECU is responsive to input of the signal to actuate, for example, a passenger restraint device such as an air bag.

In operation, when the detector-equipped vehicle collides with, for example, another vehicle and undergoes a mechanical impact or deceleration of force exceeding a preselected threshold level, it will cause the moment to act on the center of gravity of the weight 4, so that the rotor 3 rotates about the center shaft 2 in the clockwise direction, as viewed in FIG. 1. Upon rotation of the rotor 3, the first contact spring 7 is urged elastically by the cam 5 to the left and hits on the contact 8*a* of the first leaf spring 8A of the second contact spring 8, thereby closing the electrical circuit path on the printed circuit board to provide the signal indicative thereof to the ECU. Upon in put of the signal, the ECU detects occurrence of the vehicle collision and deploys the air bag.

A geometrical figure of the second contact spring 8 will be described below in detail which forms the feature of the invention.

The second contact spring 8 is, as described above, made up of the first and second leaf springs 8A and 8B which extend from the mount base 6*a* of the housing 6. The lower end of each of the first and second leaf springs 8A and 8B on the mount base 6*a* has, as clearly shown in FIG. 2(*a*), width W1 which is greater than width W2 of the upper end thereof. Specifically, each of the first and second leaf springs 8A and 8B tapers off to the upper end, so that the weight of an upper portion thereof is smaller than that of a lower portion, thereby making the first and second leaf springs 8A and 8B less susceptible to vibration, thus suppressing the contact chatter. The decrease in weight of the first and second leaf springs 8A and 8B leads to a concern about decreasing of the elastic load acting on the contact 8*a* when it engages the first contact spring 7, but however, the upper portion of each of the first and second leaf springs 8A and 8B cantilevered on the base 6*a* of the housing 6 that is the greatest in inertia weight in an overall length thereof is decreased in weight, therefore, the decreasing of the elastic load on the contact 8*a* is smaller as compared with when the overall width of each of the first and second leaf springs 8A and 8B is decreased.

Moreover, the second contact spring 8 has a double walled structure made up of the first and second leaf springs 8A and 8B, thereby compensating for the decreasing of the elastic load on the contact 8*a*, thereby ensuring an electrical contact between the first and second contact springs 7 and 8.

Figure 2A:
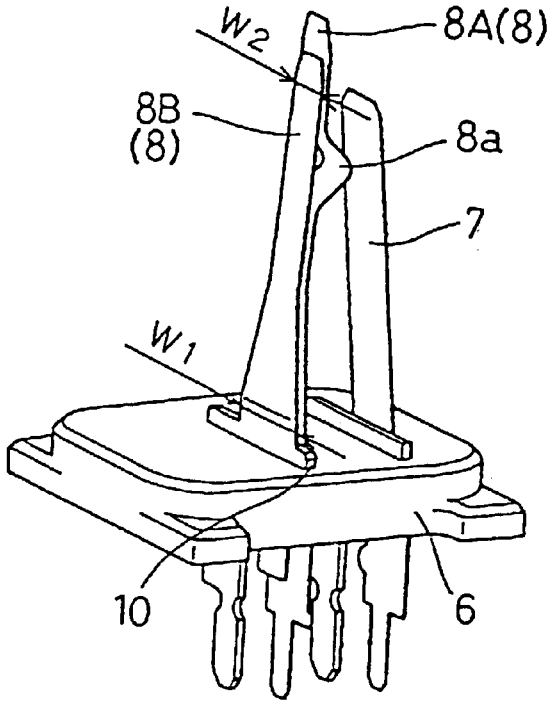
FIG. 2(*a*) is a perspective view which shows a structure of contact springs installed within the collision detector of FIG. 1.
Figure 2B:
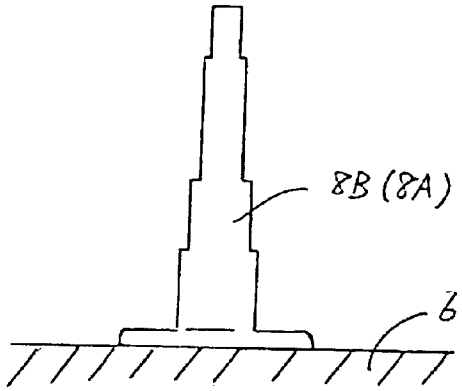

The width of each of the first and second leaf springs 8A and 8B is, as can be seen from FIG. 2(*a*), preferably decreased from the lower end at least within a lower half thereof for decreasing the weight of the upper portion to have the first and second leaf springs 8A and 8B less susceptible to vibration. The width may, however, be decreased at a constant rate as a whole or in a stepwise fashion, as illustrated in FIG. 2(*b*).

The collision detector 1 of the second embodiment will be described below.

Figure 3:
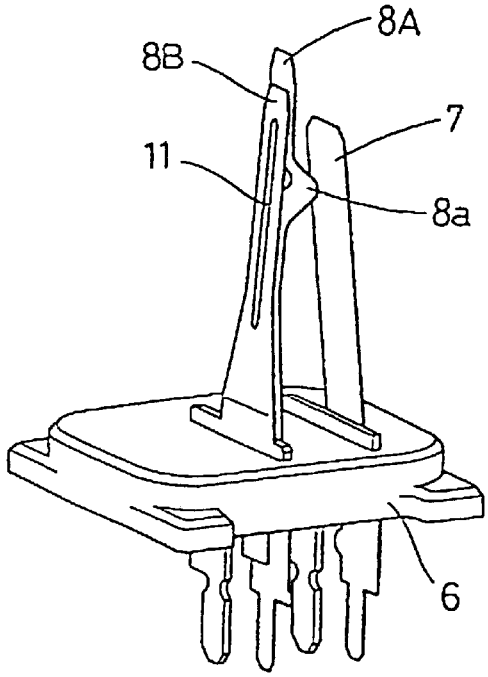
FIG. 3 is a perspective view which shows a second contact spring in the second embodiment.

FIG. 3 illustrates the first and second contact springs 7 and 8 in the second embodiment. Each of the first and second leaf springs 8A and 8B of the second contact spring 8 has formed thereon a reinforcement rib 11 (only one is shown for the brevity of illustration) which serves to compensate for a loss in rigidity resulting from the decrease in width of the upper portion of each of the first and second leaf springs 8A and 8B. This ensures the elastic load on the contact 8*a* required to secure the stability of contact between the first and second contact springs 7 and 8. The rib 11 is made using, for example, a press.

The rib 11 may alternatively be formed only one of the first and second leaf springs 8A and 8B.

The first contact spring 7 may also be made to have the same structure as that of the second contact spring 8.

Specifically, the first contact spring 7 may be increased in width from the lower to upper portion thereof either gradually or in a stepwise fashion The second contact spring 8 may alternatively be made of a single leaf spring or more than two leaf springs.

The collision detector 1 is so designed that the deceleration acting thereon causes the rotor 3 to rotate about the center shaft 2, but however, may have a rod instead of the rotor 3 which reciprocates linearly to push the first contact spring 7 upon a vehicle crash.

Figure 4:
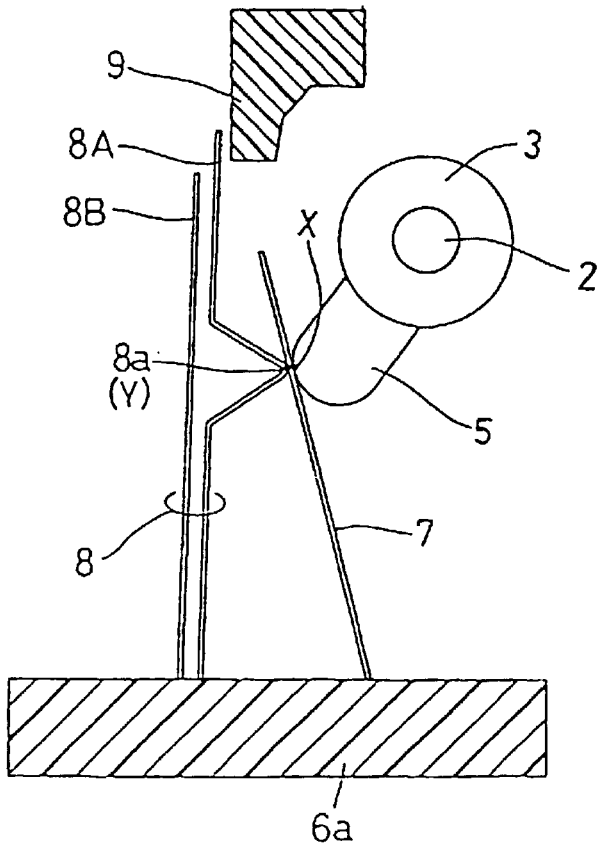
FIG. 4 is a partially sectional view which shows a collision detector according to the third embodiment.

The collision detector 1 of the third embodiment will be described below with reference to FIG. 4. The same reference numbers as employed in the above embodiments refer to the same parts, and explanation thereof in detail will be omitted here.

Figure 5:
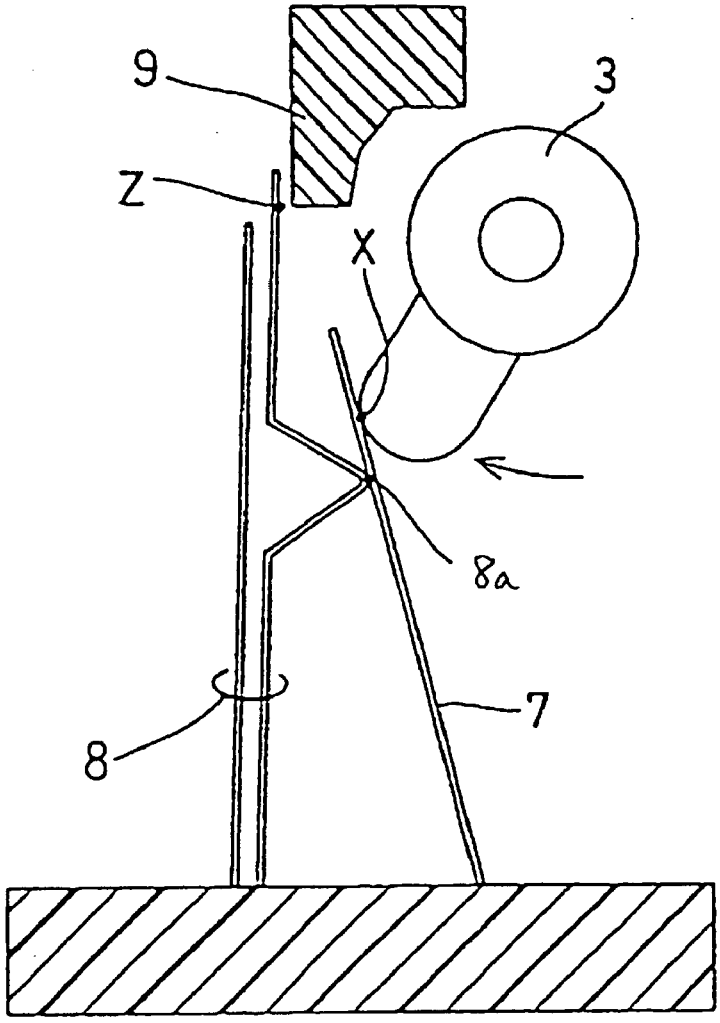
FIG. 5 PRIOR ART
FIG. 5 is a partially sectional view which shows a conventional collision detector.

The collision detector 1 of this embodiment is so designed that a contact point X between the outer surface of the cam 5 and the first contact spring 7 coincides spatially with the contact 8*a* of the second contact spring 8. In other words, the contact point X and a contact point Y between the contact 8*a* and the first contact spring 7 are located at the same interval away from the surface of the base 6*a* of the housing 6 from which the first and second contact springs 7 and 8 extend. Accordingly, upon rotation of the rotor 3 by a vehicle collision, the cam 5 hits on the contact 8*a* through the first contact spring 7 to establish an electrical contact between the first and second contact springs 7 and 8. When brought into contact with the contact 8*a* of the second contact spring 8, the first contact spring 7 is pressed by the cam 5 against the contact 8*a*, thereby suppressing mechanical vibrations of the first contact spring 7 on the contact 8*a* to avoid the contact chatter. The prior art structure, as shown in FIG. 5, have the contact point X located at a great interval away from the contact 8*a* of the second contact spring 8. Therefore, when the first contact spring 7 is brought into contact with the second contact spring 8, the contact point X lies far away from the contact 8*a*, which causes the first contact spring 7 to vibrate about the contact point X and the second contact spring 8 to also vibrate about the point Z of contact with the stopper 9, thus resulting in the contact chatter between the first contact spring 7 and the contact 8*a* of the second contact spring 8. The contact point X in this embodiment, as described above, lies in coincidence with the contact 8*a*, thus eliminating such a drawback.

The contact point X is not always necessary to coincide exactly with the contact 8*a* of the second contact spring 8, but may be located slightly above the contact 8*a* if it falls within a production tolerance. If the contact point X lies below the contact point Y between the first contact spring 7 and the contact 8*a* of the second contact spring 8, it may cause the cam 5 to get over the contact 8 upward upon a further rotation of the rotor 3 after the first contact spring 7 hits on the contact 8*a*, thereby holding the cam 5 undesirably from returning back to its original position. In order to avoid this problem, the contact point X is preferably located at least above the contact 8*a* of the second contact spring 8 to decrease the torque required for the cam 5 to get over the contact 8 and return back to the original position thereof greatly.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A collision detecting apparatus comprising:

a moving member moving when subjected to an impact of more than a given level arising from a collision with another object; and a first and a second contact member which are disposed on a mount base and extend with a given gap therebetween, said first contact member being brought by said moving member into contact with said second contact member to produce an electrical signal indicative thereof when said moving member undergoes the impact of more than the given level, at least one of said first and second contact members being made of a leaf spring which has a length including a base portion secured on the mount base and a contact portion for establishing contact with an opposing contact portion of the other of said first and second contact members, the base portion being larger in width than the contact portion;

wherein surfaces of the contact portions of the first and second contact members are slitless to increase mechanical strength thereof and to decrease a propensity of the first and second contact members to vibrate and cause contact chatter.

2. A collision detecting apparatus as set forth in claim 1, wherein the at least one of said first and second contact members is decreased in width gradually from the base portion to the contact portion.

3. A collision detecting apparatus as set forth in claim 1, wherein the at least one of said first and second contact members is decreased in width in a stepwise fashion from the base portion to the contact portion.

4. A collision detecting apparatus as set forth in claim 1, wherein said second contact member is made up of a first and a second leaf spring, the first leaf spring working to establish the contact with the first contact member when pressed by said moving member, the second leaf spring working to produce an elastic pressure to urge the first leaf spring against said first contact member when said first contact member is pressed by said moving member and makes the contact with the second contact member.

5. A collision detecting apparatus comprising:

a moving member moving when subjected to an impact of more than a given level arising from a collision with another object; and a first and second contact member which are disposed on a mount base and extent with a given gap there between, said first contact member being brought by said moving member into contact with said second member to produce an electrical signal indicative thereof when said moving member undergoes the impact of more than the given level, at least one of said first and second contact members being made of a leaf spring which has a length including a base portion secured on the mount base and a contact portion for establishing contact with an opposing contact portion the other of said first and second contact members, the base portion being larger in width than the contact portion, wherein surfaces of the contact portions of the first and second contact members are slitless to increase mechanical strength thereof and to decrease a propensity of the first and second contact members to vibrate and cause contact chatter, and wherein the leaf spring has a reinforcement rib formed thereon.

6. A collision detecting apparatus comprising:

a moving member moving when subjected to an impact of more than a given level arising from a collision with another object; and a first and a second contact member which are disposed on a mount base and extent with a given gap there between, said first contact member being brought by said moving member into contact with said second contact member to produced an electrical signal indicative thereof when said moving member undergoes the impact of more than the given level, at least one of said first and second contact members being made of a leaf spring which has a length including a base portion secured on the mount base and a contact portion for establishing contact with an opposing contact portion of the other of said first and second contact members, the base portion being larger in width than the contact portion.

wherein surfaces of the contact portions of the first and second contact members are slitless to increase mechanical strength thereof and to decrease a propensity of the first and second contact members to vibrate and cause contact chatter, and wherein a point of contact of said first contact member with said second contact member established by said moving member and a point of contact of said moving member with the first contact member are located at a same interval away from the mount base.

7. A collision detecting apparatus comprising:

a moving member moving when subjected to an impact of more than a given level arising from a collision with another object; and a first and second contact member which are disposed on a mount base and extent with a given gap there between, said first contact member being brought by said moving member into contact with second contact member to produced an electrical signal indicative thereof when said moving member undergoes the impact of more than the given level, at least one of said first and second contact members being made of a leaf spring which has a length including a base portion secured on the mount base and a contact portion for establishing contact with an opposing contact portion of the other of said first and second contact members, the base portion being larger in width than the contact portion, wherein surfaces of the contact portions of the first and second contact members are slitless to increase mechanical strength thereof and to decrease a propensity of the first and second contact members to vibrate and cause contact chatter, and wherein a point of contact of said first contact member with said second contact member established by said moving member coincides spatially with a point of contact of said moving member with the first contact member.

8. A collision detecting apparatus, comprising:

a base;

a first contact member disposed on the base; and a second contact member disposed on the base and spaced apart from the first contact member so as to define a gap therebetween, wherein the first contact member being movable into contact with the second contact member to produce an electrical signal indicative thereof upon occurrence of an impact above a predetermined impact level, at least one of the first and second contact members comprising a leaf spring having a base portion secured to the base and a contact portion for establishing contact with a contact portion of the other of the first and second contact members, the base portion being larger in width than the contact portion, surfaces of the contact portions of the first and second contact members being slitless to increase mechanical strength thereof and to decrease a propensity of the first and second contact members to vibrate and cause contact chatter, and the second contact member includes both a first contact leaf spring and a second contact leaf spring.

9. The collision detection apparatus of claim 8, wherein the leaf spring includes a reinforcement rib thereon.

10. The collision detecting apparatus as set forth in claim 8, wherein the at least one of the first and second contact members is decrease in width gradually from the base portion to the contact portion.

11. The collision detecting apparatus as set forth in claim 8, wherein the at least one of the first and second contact members is decrease in width in a stepwise fashion from the base potion to the contact portion.

* * * * *